169-43 SR
6/4/85 OR 4,520,871

United States Patent [19]

Miller et al.

[11] Patent Number: 4,520,871

[45] Date of Patent: Jun. 4, 1985

[54] FIRE EXTINGUISHING SYSTEM

[75] Inventors: Walter G. Miller, Mississauga; Michel Macé, Montreal; George Zitterbart, Mississauga, all of Canada

[73] Assignee: Wormald Fire Systems, Inc., Montreal, Canada

[21] Appl. No.: 439,546

[22] Filed: Nov. 5, 1982

[30] Foreign Application Priority Data

Nov. 1, 1982 [CA] Canada ..... 414603

[51] Int. Cl.[3] ..... A62C 1/06; A62C 13/26

[52] U.S. Cl. ..... 169/43; 169/9

[58] Field of Search ..... 169/43, 54, 56, 60, 169/61, 5, 9, 11, 16, 17, 72, 85

[56] References Cited

U.S. PATENT DOCUMENTS

| | | | |
|---|---|---|---|
| 868,218 | 10/1907 | Osborne | 169/9 |
| 2,290,358 | 7/1942 | Rider | 169/17 |
| 2,933,139 | 4/1960 | O'Rear | 169/16 X |
| 3,052,304 | 9/1962 | Williamson et al. . | |
| 3,486,562 | 12/1969 | Goodloe et al. . | |
| 3,497,012 | 2/1970 | Williamson . | |
| 4,069,873 | 1/1978 | McClure . | |
| 4,183,409 | 1/1980 | Iida . | |

*Primary Examiner*—Andres Kashnikow

*Attorney, Agent, or Firm*—Cushman, Darby & Cushman

[57] ABSTRACT

The disclosure herein describes a system for extinguishing fires which consists in first maintaining a supply of liquid fire extinguishing medium in a tank under a pressure cushion of expellant material; the medium is delivered upon detection of a hazard by opening a normally closed valve in a delivery line connected to the tank; this operation triggers a sequential operation of a plurality of groups of expellant containers which causes additional expellant material to be delivered to the tank to maintain therein a given pressure so as to effect quick and total evacuation of the fire extinguishing medium from the tank to the hazard.

14 Claims, 2 Drawing Figures

To 84D
To 84C
To 84B
To 84A
FROM 86

FIRE EXTINGUISHING SYSTEM

FIELD OF THE INVENTION

The present invention relates to a system for the extinguishment of fires with a fire extinguishing medium.

BACKGROUND OF THE INVENTION

In enclosures of large sizes, such as rooms where electrical equipment is stored, it is essential that quick and total evacuation of the fire extinguishing medium be effected so as to establish in the entire room an atmosphere in which combustion cannot take place. One evident solution is to install a great number of receptacles storing the pressure medium with a common discharge manifold or delivery line. However, the installation of such a system is extremely costly in addition to taking considerable space. Indeed, each cylinder must be separately equipped with valves, rupture disks and pressure gages, thereby requiring individual maintenance. Furthermore, where a large size room may require a hundred or so of these receptacles, it is to be noted that filling time for each with the medium takes, as an average, over one hour.

OBJECTS AND STATEMENT OF THE INVENTION

It is an object of the present invention to provide a fire extinguishing system where a single large tank is used where the delivery of the fire extinguishing medium is quick and, in a short time, total evacuation of the fire extinguishing medium is achieved.

This invention is achieved by providing a system where the fire extinguishing medium partially fills the tank and where an expellant material under pressure occupies the remaining part of the tank, the expellant material defining a pressure cushion acting on the fire extinguishing medium; a delivery line for carrying the medium from the tank to a hazard is equipped with a normally closed main valve which is operable to deliver the fire extinguishing medium to the hazard; the system also includes a reserve of expellant containing means in conduit communication with the pressure cushion inside the tank; actuator means operate the valve and initiate the sequential operation of the expellant containing means for the delivering of additional expellant material to the tank to maintain a given pressure in the tank and to effect a quick and total evacuation of the medium from the tank to the hazard.

In one preferred form of the invention, the medium is a liquid halogenated hydrocarbon and the expellant material is nitrogen.

The present invention is also concerned with a method of extinguishing fires which comprises the steps of:

maintaining a supply of liquid fire extinguishing medium in the tank under a pressure cushion of expellant material;

initiating delivery of the medium through a delivery line upon detection of a hazard by opening a normally closed valve in the delivery line; and initiating a sequential operation of a plurality of serially operable groups of expellant containing means in conduit communication with the expellant material in the tank to thereby deliver additional expellant material to the tank to maintain a given pressure in the tank for quick and total evacuation of the medium from the tank to the hazard.

The scope of applicability of the present invention will become apparent from the detailed description given hereinafter; it should be understood, however, that this description, while indicating preferred embodiments of the invention, is given by way of illustration only, since various changes and modifications within the spirit and scopes of the invention will become apparent to those skilled in the art.

IN THE DRAWINGS

FIG. 1 is a diagrammatic view of a fire extinguishing system, illustrating one embodiment of the present invention; and FIG. 2 is a diagrammatic view of the groups of cylinders.

DESCRIPTION OF PREFERRED EMBODIMENTS

Figure 1:
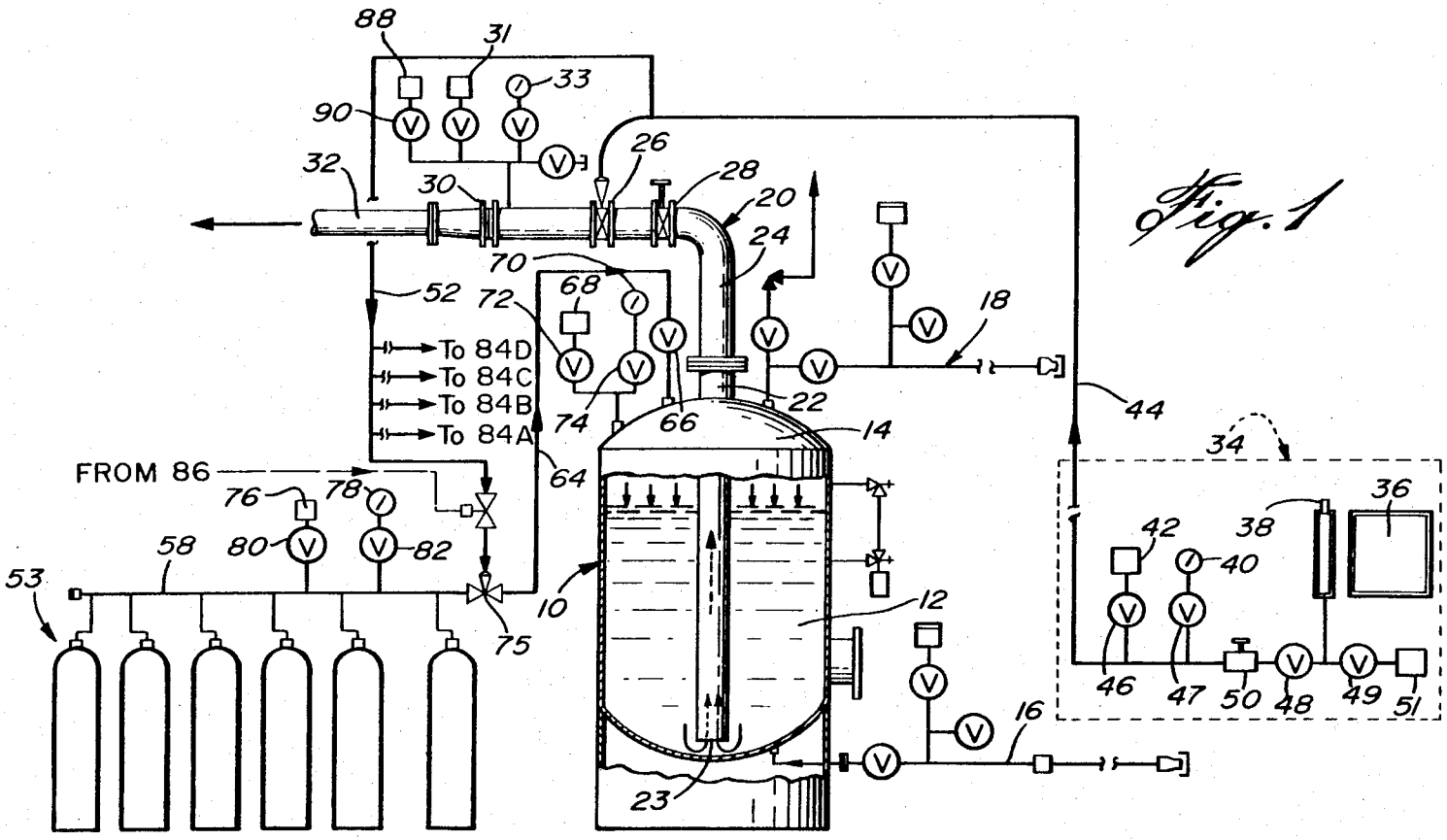

As illustrated in the drawings, there is shown a large storage tank 10 which is partially filled with a liquid fire extinguishing medium 12 above which is a cushion of expellant material 14 under pressure. A preferred medium is a liquid halogenated hydrocarbon, such as the one sold under the trade mark HALON 1301, while a preferred expellant material is nitrogen. A fill line 16 is shown at the bottom of the tank for storing the medium in the tank and includes a series of commonly known and used components such as valves, rupture disks, coupling adaptors for the proper filling operation of the tank. Also shown is an equalizing line 18 connected between the tank and the source of medium 12 and equipped with similar known components, such as valves, rupture disks, coupling adaptors, for use during the conventional filling operation of a medium containing tank.

A delivery line, generally denoted 20, includes a first portion 22 which extends inside the storage tank with one end 23 terminating adjacent the bottom thereof. A second portion 24 of the delivery line comprises a normally closed remotely operated main valve 26, preferably of the butterfly type, and a second valve 28 which is normally open and is used whenever maintenance is required on the main valve 26. The delivery line portion 24 further includes a rupture disk 30 which is located downstream of the main valve 26 and which is used for detecting any leaks of the fire extinguishing medium which may accidently pass by valve 26 when closed. An arrangement of pressure detecting device 31, manometer 33 and valves is provided between valve 26 and disk 30 to indicate to a controlling station, generally designated as 34, an increase or decrease in pressure in the delivery line. The remaining portion 32 of the delivery line is connected to a nozzle distributing system (not shown) which is mounted in the environment to be protected.

The actuation, i.e. opening, of the butterfly valve 26 is carried out upon receiving a signal transmitted from the controlling station which, in turn, operates upon detection of a fire hazard in the room where the distributing system is located. The station includes a control panel 36, a pneumatic actuator 38, a manometer 40 and a pressure detecting switch 42. The controlling station 34 also includes a series of valves 46, 47, 48, 49, a pressure regulator 50 and a pressure detecting instrument 51.

Figure 2:
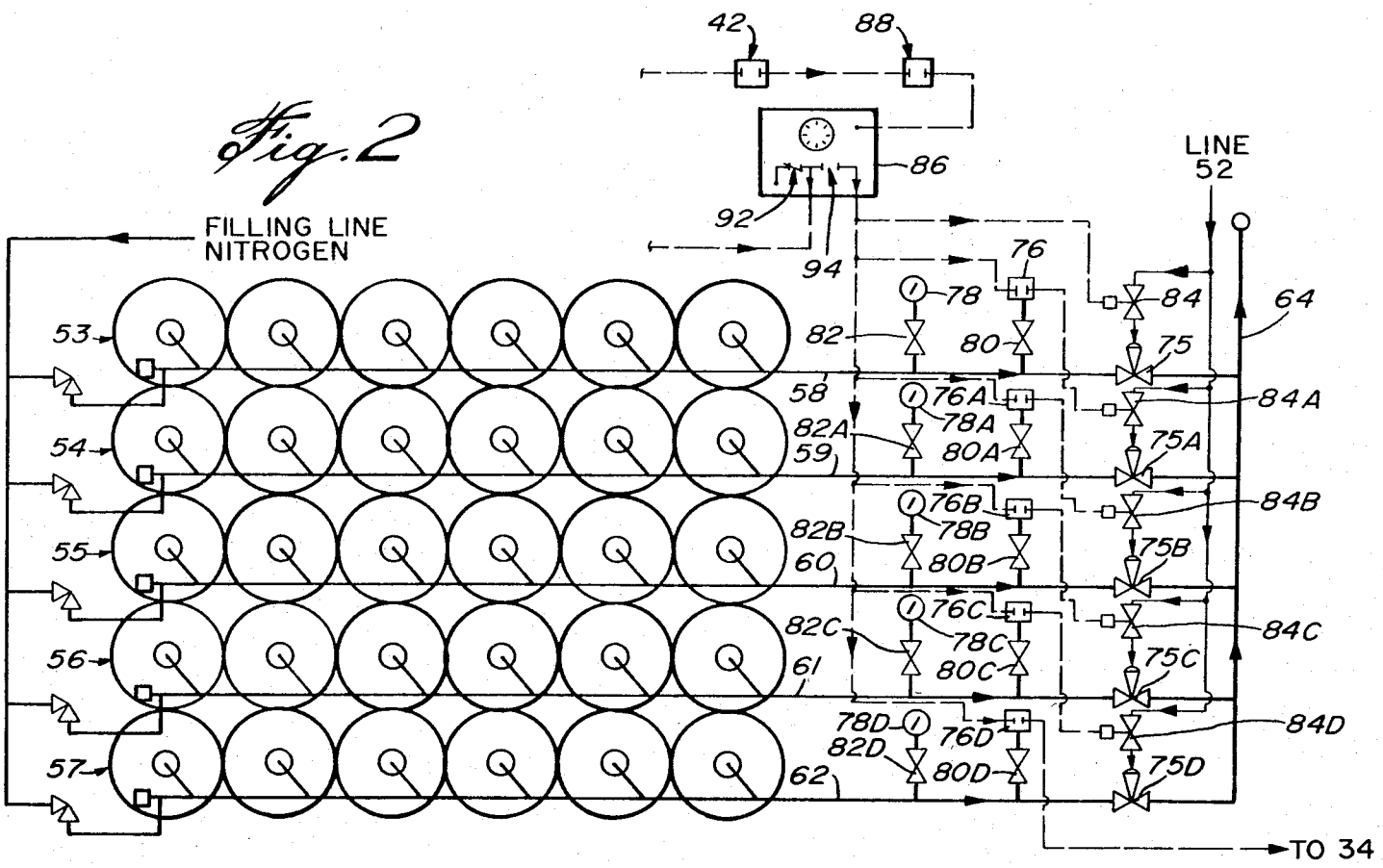

The signal transmitted on line 44 from the controlling station 34 is also transmitted on a second line 52 associated with a plurality of groups of containers, five groups having been shown in FIG. 2 as 53, 54, 55, 56, 57, each group including a series of cylinders (six being shown). The containers of each group are serially connected to a common delivery line 58, 59, 60, 61, 62, respectively, each line being in conduit communication with the upper part of the tank 10 through a common conduit 64 and a valve 66. Mounted to the upper part of the storage tank are a pressure detecting device 68 and a manometer 70, in communication with the tank through respective valves 72 and 74, to detect and measure the pressure therein. The pressure detecting device 68 will indicate a variation in pressure inside the tank and will transmit a signal to the controlling station. An increase of pressure inside the tank will indicate an increase of temperature which will create expansion of the medium inside the tank and/or a leak of the expellant material. A decrease in pressure will indicate a leak of the expellant material or of the fire extinguishing medium and/or a temperature decrease. The first group 53 includes a diaphragm operated valve 75 in the delivery line 58, a pressure detecting device 76 connected to line 58 through a valve 80, a manometer 78 also connected to line 58 through a valve 82. Similar component arrangements are provided for each of the other lines 54, 55, 56 and 57 and have been given letter references to distinguish them from one another.

To line 52 are connected solenoid valves 84, 84 A, 84 B, 84 C and 84 D which, when operated, actuate respective valves 75, 75 A, 75 B, 75 C and 75 D. Solenoid valve 84 is electrically connected to a timer device 86. The other solenoid valves are connected to the timer through respective pressure switches 76, 76 A, 76 B, 76 C and 76 D. Connected to the timer are two normally opened contacts 42 and 88 which close in response to the a pressure increase in lines 44 and 20 respectively. Timer 86 also includes a pair of contacts 92 (normally closed) and 94 (normally open).

A description of the operation of the present system will now be described. Under normal situation, tank 10 contains a quantity of fire extinguishing medium in liquid state which is pressurized by the cushion of expellant material 14. The butterfly valve 26 is normally closed while the rupture disk 30 is in place; valve 28 is open. The opening of butterfly valve 26 is actuated by a pneumatic or electric signal received from the controlling station 34.

The number of groups of cylinders of expellant material will correspond to that which is required to assist the cushion of expellant material inside the tank to expel quickly and totally the fire extinguishing medium to the hazard in a desired time interval. Once triggered, the signal received from the controlling station opens the butterfly valve 26. This signal is also sent to the solenoid valves 84, 84 A, 84 B, 84 C and 84 D; however, these valves will actuate their corresponding valves 75, 75 A, 75 B, 75 C and 75 D only when electrically energized. Solenoid valve 84 will be actuated when timer 86 is energized: this is accomplished when contacts 42 and 88 are closed. Contact 42 is closed when the controlling station sends a signal on line 44 whereas contact 88 is closed when the pressure inside conduit 20 between valves 26 and disc 30 is sufficiently high and detected by switch 88. Timer 86, once energized, will cause and maintain closure of contact 94 for a set delay resulting in actuation of valve 84 and valve 75. This will cause the first group 53 of six cylinders to direct additional expellant material to the tank through conduit 64, the latter acting as an orifice and reducing the pressure of expellant material from a high value inside the containers to a sufficient pressure to expel the medium from the tank. When the pressure of the first group of cylinders decreases and reaches a low value, the contact of pressure detecting device 76 closes to actuate the solenoid valve 84 A of the succeeding group of six containers, which valve opens an associated valve 75 A to put the expellant material of that group in communication with line 64; and so on, until the last group of containers is emptied. This sequential operation enables to maintain a constant pressure inside the tank during the delivery time. The pressure detecting device 76 D of the last or fifth group transmits a signal to the controlling station 34 to indicate total evacuation of the expellant material. The set delay on timer 86 corresponds to the time required for total evacuation of the medium and ensures this continuous electric supply even if contacts 42 and 88 should open.

Although the invention has been described above in respect of a specific form, it will be evident to the man skilled in the art that it can be modified and refined in various ways. For example, the gas under pressure in the containers could be air. However, in such a case, air would react with the halogenated hydrocarbon and it would be preferable that the pressure cushion inside the tank be nitrogen while the expellant material outside the tank would be air or any other material under pressure. Also, it is possible to envisage the reserve of expellant material as being a large spherical container. It is therefore wished to have it understood that this invention should not be limited in interpretation except by the terms of the following claims.

The embodiments of the invention in which an exclusive property or privilege is claimed are defined as follows:

1. A fire extinguishing system comprising:

(a) a tank;

(b) a fire extinguishing medium partially filling said tank;

(c) an expellant material under pressure in the remaining part of the tank, said material defining a pressure cushion acting on said medium;

(d) a delivery line associated with said tank for carrying said medium from said tank to a hazard;

(e) valve means in said delivery line including a normally closed main valve operable to open said delivery line to deliver said fire extinguishing medium to said hazard;

(f) a reserve of expellant containing means in conduit communication with said cushion in said tank, said expellant containing means including a plurality of groups of serially connected cylinders;

(g) actuator means for operating said main valve and for initiating sequential delivery of said expellant containing means for delivering additional expellant material to said tank to maintain a predetermined pressure therein for quick and total evacuation of said medium from said tank to said hazard.

2. A fire extinguishing system as defined in claim 1, wherein said medium is a liquid halogenated hydrocarbon.

3. A fire extinguishing system as defined in claim 1 or 2, wherein said expellant material is nitrogen.

4. A fire extinguishing system as defined in claim 1, wherein said actuator means include means responsive to a signal originating from a controlling station associated with said system.

5. A fire extinguishing system as defined in claim 4, wherein said groups are successively operable; means associated with each of said groups of cylinders for detecting a fiven pressure and for switching to a successive group of cylinders are provided.

6. A fire extinguishing system as defined in claim 5, wherein the pressure detecting means of the last group of cylinders includes means for transmitting a signal to said controlling station to indicate termination of said expellant delivering operations.

7. A fire extinguishing system as defined in claim 6 comprising time setting means connected to said pressure detecting means for ensuring operation of said pressure detecting means during a time corresponding to said total evacuation.

8. A fire extinguishing system as defined in claim 4 wherein said signal is pneumatic.

9. A fire extinguishing system as defined in claim 1, wherein one end of said delivery line extends to the bottom of said tank.

10. A fire extinguishing system as defined in claim 1, wherein said valve means further includes a second valve upstream of said main valve in said delivery line and a rupture disk therein downstream of said main valve for detecting leak of said medium through said normally closed main valve; said disk being ruptured upon evacuation of said medium through said delivery line.

11. A method of extinguishing a fire comprising the steps of:

(a) maintaining a supply of liquid fire extinguishing medium in a tank under a pressure cushion of expellant material;

(b) initiating delivery of said medium through a delivery line upon detection of a hazard by opening a normally closed valve in said delivery line;

(c) initiating the sequential operation of a plurality of serially operable groups of expellant containers in conduit communication with said expellant material in said tank to thereby deliver additional expellant material to said tank to maintain a given pressure in said tank for quick and total evacuation of said medium from said tank to said hazard.

12. A method as defined in claim 11, comprising the step of maintaining said expellant material in one group of containers until a selected pressure level in a preceding group of containers is reached.

13. A method as defined in claim 12, comprising the step of transmitting a signal to a controlling station when the last group of containers has reached said falling pressure.

14. A method as defined in claim 11, 12 or 13, wherein said medium is a liquid halogenated hydrocarbon and said expellant material is nitrogen.

* * * * *